US007253830B2

(12) United States Patent
Matsui

(10) Patent No.: US 7,253,830 B2
(45) Date of Patent: Aug. 7, 2007

(54) ROTARY APPARATUS INCLUDING A ROTATION SHAFT AND SLEEVE HAVING TAPPED PORTIONS, AND LASER BEAM PRINTER HAVING THE SAME

(75) Inventor: Toshiharu Matsui, Osaka (JP)

(73) Assignee: Funai Electric Co., Ltd., Daito-shi (JP)

( * ) Notice: Subject to any disclaimer, the term of this patent is extended or adjusted under 35 U.S.C. 154(b) by 215 days.

(21) Appl. No.: 11/019,249

(22) Filed: Dec. 23, 2004

(65) Prior Publication Data

US 2005/0140774 A1 Jun. 30, 2005

(30) Foreign Application Priority Data

Dec. 25, 2003 (JP) ..... P2003-430864

(51) Int. Cl.
*B41J 27/00* (2006.01)
*B41J 2/435* (2006.01)

(52) U.S. Cl. ..... 347/261; 347/224

(58) Field of Classification Search ..... 347/224, 347/238, 260, 261; 29/596
See application file for complete search history.

(56) References Cited

U.S. PATENT DOCUMENTS 5,270,737 A * 12/1993 Nakasugi et al. ..... 347/260
2003/0024102 A1* 2/2003 Danish et al. ..... 29/596

FOREIGN PATENT DOCUMENTS

JP 04-107313 4/1992

* cited by examiner

*Primary Examiner*—Hai Pham
*Assistant Examiner*—Carlos A. Martinez, Jr.
(74) *Attorney, Agent, or Firm*—Crowell & Moring LLP

(57) ABSTRACT

A rotary apparatus for a polygon mirror has: a sleeve; a rotation shaft which is inserted into the sleeve; the polygon mirror which is fixed to the rotation shaft; a yoke which is fixed to the rotation shaft; permanent magnets which are fixed to the yoke; and a stator which is fixed to the sleeve, and which is opposed to the permanent magnets. Tapped portions are formed in a part of the outer circumference of the rotation shaft, and a part of the inner circumference of the sleeve, respectively. The tapped portions are temporarily engaged with each other in a process of inserting the rotation shaft into the sleeve. The rotation direction of the rotation shaft in a driving process is identical with that of the rotation shaft in the inserting process.

6 Claims, 1 Drawing Sheet

ROTARY APPARATUS INCLUDING A ROTATION SHAFT AND SLEEVE HAVING TAPPED PORTIONS, AND LASER BEAM PRINTER HAVING THE SAME

BACKGROUND OF THE INVENTION

1. Field of the Invention

The present invention relates to a rotary apparatus and a laser beam printer having a rotary apparatus, and more particularly to a rotary apparatus for rotating a polygon mirror or the like, and a laser beam printer having such a rotary apparatus.

2. Description of the Related Art

Recently, a rotary apparatus is requested to conduct high-speed or high-accuracy rotation. For example, a laser beam printer requires a high-accuracy rotary apparatus for a polygon mirror. Such a rotary apparatus must be designed so as to prevent the polygon mirror from dropping off during a rotating process.

For example, JP-A-4-107313 discloses a rotary bearing which has a hydrodynamic bearing, and in which a concave portion is disposed in a rotation shaft, a projecting member that is to be fitted into the concave portion in a contactless manner is disposed on a sleeve, and the projecting member has a shape that, when the rotation shaft is fitted into the sleeve, is easily deformed, and that is caught in the pulling out direction, thereby preventing the rotation shaft from dropping off.

In this structure, a rotary member attached to the rotation shaft is prevented from being lifted up more than needed from a fixing member, or being pulled out thereof.

In the apparatus of JP-A-4-107313, however, the projecting member must have an elastic shape, and hence must be thinned, so that the durability is reduced. When the projecting member is made of a material different from that of the sleeve or formed as a part separate from the sleeve, the number of production steps and the production cost are increased. Moreover, the rotation shaft is hardly pulled out of the sleeve, and hence the rotation shaft and the sleeve must be replaced together with new ones in a repairing process or the like.

SUMMARY OF THE INVENTION

It is an object of the invention to provide a rotary apparatus in which a rotation shaft can be easily attached to a sleeve in an assembling process, does not drop off the sleeve in a driving process, and can be easily pulled out of the sleeve in a disassembling process, and which can reduce the number of production steps and the production cost. It is another object of the invention to provide a laser beam printer having such a rotary apparatus.

In order to attain the objects, the invention provides a rotary apparatus in which a rotation shaft that is inserted into a sleeve is rotated, wherein tapped portions are formed in a part of an outer circumference of the rotation shaft, and a part of an inner circumference of the sleeve, respectively; the tapped portions are temporarily engaged with each other in a process of inserting the rotation shaft into the sleeve by a rotating of the rotation shaft to a predetermined direction, and then the tapped portions are separated from each other by continuing the rotating; the rotation shaft that is inserted into the sleeve is retained by the separated condition; and a rotation direction of the rotation shaft in a driving process is identical with the predetermined direction.

When tapped portions 21*a*, 22*a* are formed as described above, it is possible to realize a rotary apparatus in which the rotation shaft can be easily attached to the sleeve in an assembling process, does not drop off the sleeve in a driving process, and can be easily pulled out of the sleeve in a disassembling process, and which can reduce the number of production steps and the production cost. Furthermore, the shape due to taps is advantageous also from the viewpoint of durability.

The invention provides also a laser beam printer including: a rotary apparatus having: a sleeve; a rotation shaft which is inserted into the sleeve; a polygon mirror which is fixed to the rotation shaft; a yoke which is fixed to the rotation shaft; permanent magnets which are fixed to the yoke; and a stator which is fixed to the sleeve, and which is opposed to the permanent magnets; a laser oscillating apparatus; and a photosensitive drum, wherein tapped portions are formed in a part of an outer circumference of the rotation shaft, and a part of an inner circumference of the sleeve, respectively; the tapped portions are temporarily engaged with each other in a process of inserting the rotation shaft into the sleeve by a rotating of the rotation shaft to a predetermined direction, and then the tapped portions are separated from each other by continuing the rotating; the rotation shaft that is inserted into the sleeve is retained by the separated condition; and a rotation direction of the rotation shaft in a driving process is identical with the predetermined direction.

When the rotary apparatus having the tapped portions are used as an apparatus for rotating a polygon mirror of a laser beam printer as described above, it is possible to realize a laser beam printer having a rotary apparatus in which the rotation shaft can be easily attached to the sleeve in an assembling process, does not drop off the sleeve in a driving process, and can be easily pulled out of the sleeve in a disassembling process, and which can reduce the number of production steps and the production cost.

According to the invention, a tapped portion is formed on each of a rotation shaft of a rotary apparatus and a sleeve, whereby the rotation shaft can be easily attached to the sleeve in an assembling process, prevented from dropping off the sleeve in a driving process, and easily pulled out of the sleeve in a disassembling process, and the number of production steps and the production cost can be reduced.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
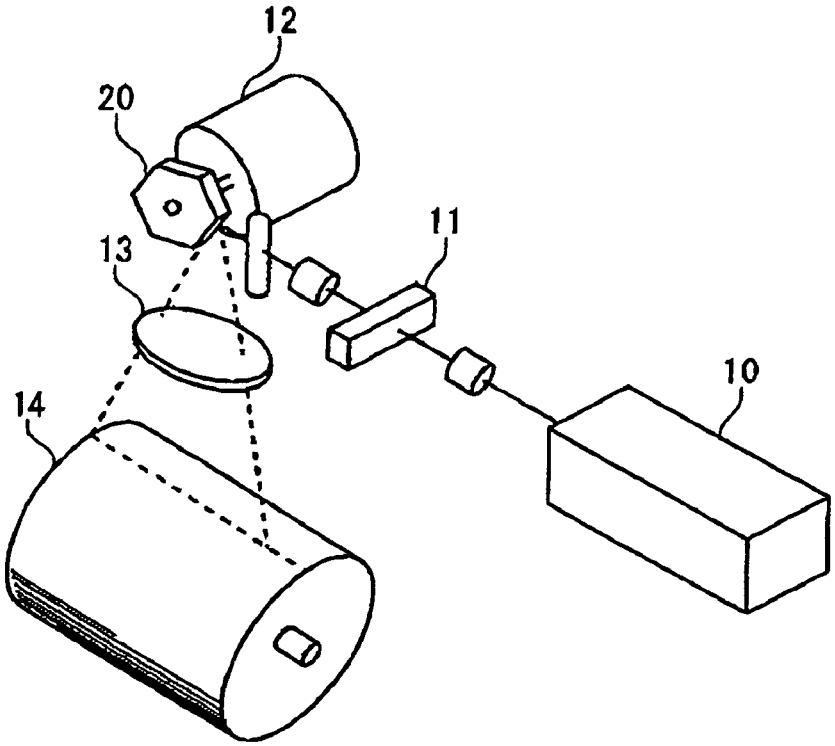
FIG. 1 is a diagram illustrating an optical system of a laser beam printer according to the invention.

FIG. 1 is a diagram illustrating an optical system of a laser beam printer. The reference numeral 10 denotes a laser oscillating apparatus having a gas laser, a semiconductor laser, or the like, 11 denotes a light modulation device which on/off-controls a light beam emitted from the laser oscillating apparatus 10, 12 denotes a rotary apparatus having a polygon mirror 20 which is rotated at a high speed, 13 denotes an f. lens which corrects the spot shape of the light beam, and 14 denotes a photosensitive drum onto which information is written by the light beam.

When information is to be written in one row onto the photosensitive drum 14, the light beam emitted from the laser oscillating apparatus 10 is on/off-controlled by the light modulation device 11 and then subjected to a sweep exposing process by the polygon mirror 20 which is rotated at a high speed. Thereafter, the spot shape of the light beam is corrected by the f. lens 13, and the light beam then impinges on the photosensitive drum 14.

Figure 2:
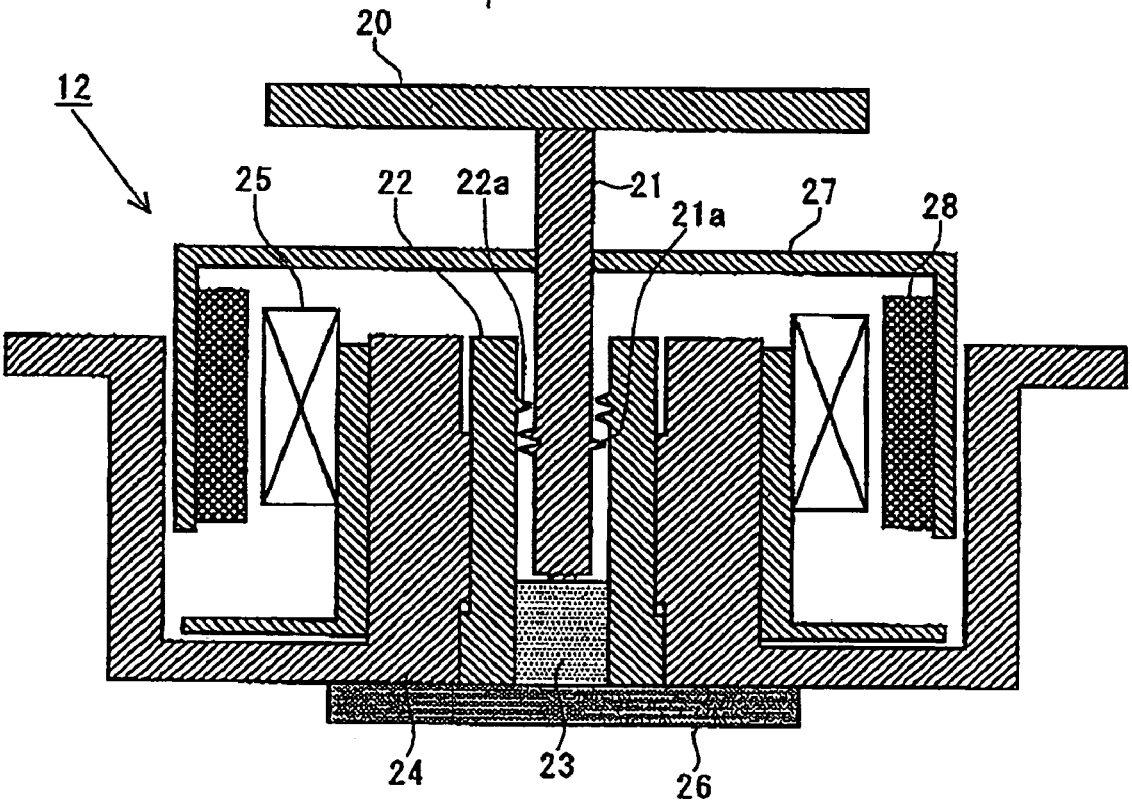
FIG. 2 is a side section view of a rotary apparatus according to the invention.

The rotary apparatus 12 will be described in detail. FIG. 2 is a side section view of the rotary apparatus. A rotation shaft 21 is inserted into a sleeve 22, and the lower end of the rotation shaft 21 is rotatably supported by a bearing 23 which is disposed inside the sleeve 22. An outer tube 24 is disposed outside the sleeve 22, and a stator 25 is disposed outside the outer tube 24. The sleeve 22, the bearing 23, and the outer tube 24 are fixed onto a fixing plate 26.

The polygon mirror 20 and a yoke 27 are fixed to the rotation shaft 21. Permanent magnets 28 are disposed in positions of the yoke 27 which are opposed to the stator 25, respectively.

Tapped portions 21*a*, 22*a* are formed on a part of the outer circumference of the rotation shaft 21, and a part of the inner circumference of the sleeve 22, respectively. In an assembling process, the rotation shaft 21 is inserted into the sleeve 22, and then rotated in a predetermined direction, so that the tapped portions 21*a*, 22*a* are engaged with each other. Thereafter, the attachment of the rotation shaft 21 is completed in a state where the tapped portions 21*a*, 22*a* are separated from each other.

The rotation direction of the rotation shaft 21 in a driving process is set so as to be identical with that of the rotation shaft 21 in the inserting process. Even when vibrations or the like occur during the driving process, therefore, the tapped portions 21*a*, 22*a* may bump against each other, but the rotation shaft 21 does not drop off. Also when vibrations or the like occur in a stopped state, the tapped portions 21*a*, 22*a* may bump against each other, but the rotation shaft 21 does not drop off. By contrast, when the rotary apparatus is to be disassembled for the purpose of repair or the like, the rotation shaft 21 is rotated in the direction opposite to that in which the rotation shaft is rotated in assembling process, thereby enabling the rotation shaft to be easily detached from the sleeve.

Since the tapped portions 21*a*, 22*a* are formed as described above, it is possible to realize a rotary apparatus in which the rotation shaft 21 can be easily attached to the sleeve 22 in the assembling process, does not drop off the sleeve in the driving process, and can be easily pulled out of the sleeve in the disassembling process, and which can reduce the number of production steps and the production cost. Furthermore, the shape due to taps is advantageous also from the viewpoint of durability.

When the tapped portions 21*a*, 22*a* are formed so as to make at least one turn, the tapped portions can function. When the tapped portions are formed so as to make a large number of turns, the assembling process requires a prolonged time period. Therefore, it is preferable to form the tapped portions 21*a*, 22*a* so as to make about one to three turns. When the tapped portions 21*a*, 22*a* are formed so that the distance between the portions in the assembled state is short, the degree of vertical runout of the rotation shaft 21 can be reduced.

In the embodiment, the sleeve 22, the bearing 23, the outer tube 24, and the fixing plate 26 are formed as separate parts. Alternatively, two or more of these parts may be integrally molded if possible. The rotation shaft 21 may be rotated by a motor in place of the stator 25 and the permanent magnets 28.

The invention can be applied to a rotary apparatus for rotating a polygon mirror of a laser beam printer, and also to a rotary apparatus in which a rotation shaft is disposed inside a sleeve.

What is claimed is:

1. A laser beam printer comprising:

a rotary apparatus having: a sleeve; a rotation shaft which is inserted into the sleeve; a polygon mirror which is fixed to the rotation shaft; a yoke which is fixed to the rotation shaft; permanent magnets which are fixed to the yoke; and a stator which is fixed to the sleeve, and which is opposed to the permanent magnets;

a laser oscillating apparatus; and a photosensitive drum, wherein:

tapped portion is formed in a part of an outer circumference of the rotation shaft, and a part of an inner circumference of the sleeve, respectively;

the tapped portions are temporarily engaged with each other in a process of inserting the rotation shaft into the sleeve by a rotating of the rotation shaft to a predetermined direction, and then the tapped portions are separated from each other by continuing the rotating;

the rotation shaft that is inserted into the sleeve is retained by the separated condition; and a rotation direction of the rotation shaft in a driving process is identical with the predetermined direction.

2. The laser beam printer of claim 1, wherein the tapped portions of the rotation shaft and the sleeve extend beyond untapped portions of the rotation shaft and the sleeve, respectively.

3. The laser beam printer of claim 1, wherein the tapped portions of the rotation shaft and the sleeve are engaged with each other for about one to three rotations of the rotation shaft.

4. A rotary apparatus comprising:

a rotation shaft; and a sleeve, wherein;

tapped portions are formed in a part of an outer circumference of the rotation shaft, and a part of an inner circumference of the sleeve, respectively, the tapped portions are temporarily engaged with each other in a process of inserting the rotation shaft into the sleeve by a rotating of the rotation shaft to a predetermined direction, and then the tapped portions are separated from each other by continuing the rotating;

the rotation shaft that is inserted into the sleeve is retained by the separated condition; and a rotation direction of the rotation shaft in a driving process is identical with the predetermined direction.

5. The rotary apparatus of claim 2, wherein the tapped portions of the rotation shaft and the sleeve extend beyond untapped portions of the rotation shaft and the sleeve, respectively.

6. The rotary apparatus of claim 2, wherein the tapped portions of the rotation shaft and the sleeve are engaged with each other for about one to three rotations of the rotation shaft.

* * * * *